US005188232A

United States Patent [19]

Carver

[11] Patent Number: 5,188,232

[45] Date of Patent: Feb. 23, 1993

[54] DISPLAY CARRIER WITH DIVIDING MEMBER

[75] Inventor: Robert G. Carver, Ashland, Ohio

[73] Assignee: Coburn, Inc., Ashland, Ohio

[21] Appl. No.: 748,533

[22] Filed: Aug. 22, 1991

[51] Int. Cl.[5] ..... B65D 85/44

[52] U.S. Cl. ..... 206/426; 206/45.14; 206/434; 229/40

[58] Field of Search ..... 206/45.14, 155, 178, 206/182, 186, 426, 434; 229/120.15, 120.16, 40

[56] References Cited

U.S. PATENT DOCUMENTS

| | | | |
|---|---|---|---|
| Re. 29,063 | 12/1976 | Graser | 206/178 |
| 2,893,593 | 7/1959 | Toensmeier | 229/120.15 |
| 3,854,580 | 12/1974 | Hennessey | 206/426 |
| 4,130,202 | 12/1978 | Champlin et al. | 206/434 |
| 4,219,148 | 8/1980 | Garmon | 229/120.15 |
| 4,381,057 | 4/1983 | Carver | 206/426 |
| 4,640,417 | 2/1987 | Durand | 206/45.14 |
| 4,798,291 | 1/1989 | Carver | 229/40 |
| 4,875,585 | 10/1989 | Kadleck et al. | 229/40 |
| 4,890,737 | 1/1990 | Kadleck et al. | 206/426 |

FOREIGN PATENT DOCUMENTS

| | | | |
|---|---|---|---|
| 2341489 | 9/1977 | France | 229/120.15 |
| 2562513 | 10/1985 | France | 206/426 |

*Primary Examiner*—David T. Fidei

*Attorney, Agent, or Firm*—Renner, Otto, Boisselle & Sklar

[57] ABSTRACT

A display carrier has top and bottom walls, first and second sidewalls, at least one vertical partition wall and a horizontal dividing member in the sleeve. The vertical partition wall extends between the top and bottom walls to define adjacent interior compartments within the sleeve. The horizontal dividing member may be connected to the first and second sidewalls and comprises (1) a first horizontal panel that is cut primarily from the bottom wall and is connected to the first sidewall along a horizontal fold line where the panel is connected to the first sidewall; and (2) a second horizontal panel that also is cut primarily from the bottom wall and is connected to the partition wall along a horizontal fold line where the panel is connected to the partition wall. Alternatively, the horizontal dividing member comprises a horizontal panel extending continuously as a single piece and having opposed ends which do not reach their respective sidewalls. The horizontal panel is cut primarily from a vertical partition wall as a single piece and is connected to the partition wall along a pair of aligned horizontal hinge lines where the panel intersects and is integral with the partition wall. Support members cut primarily from the bottom wall are used for supporting the opposed ends of the horizontal panel to form a substantially horizontal dividing member.

15 Claims, 5 Drawing Sheets

DISPLAY CARRIER WITH DIVIDING MEMBER

FIELD OF THE INVENTION

The present invention relates to display carriers which are easy to assemble and fill with articles to be displayed such as glassware. More specifically, the invention relates to one-piece cardboard carriers or holders which form sleeves to encircle the articles and have a dividing member extending horizontally across the interior of the carton.

BACKGROUND OF THE INVENTION

Glassware is commonly sold in cardboard containers which wrap around two, four or possibly more glasses. Typically, the containers have a top, a pair of sides and a bottom joined together to form a sleeve surrounding the glasses. At least one partition wall extends vertically from the top to the bottom to define adjacent interior compartments within the sleeve and to keep the bottom from sagging. A pair of glasses are put side-by-side into each compartment of the sleeve. Tabs folded down from the top of the sleeve may separate the rims of the glasses in each compartment. A horizontal dividing member may keep the adjacent glasses in each compartment from touching at their bottoms. These carriers arrive at a glassware factory in a flattened state. When glassware is ready for shipping, a worker must erect the container and insert the appropriate number of glasses in it.

Several types of horizontal dividing members have been used in collapsible display carriers. One form is connected to both sides of the carrier and extends continuously as a single piece between them. This type of dividing member is formed integrally with the partition wall and folds along a horizontal line where the dividing member intersects the plane of the partition wall. This type of horizontal dividing member is disclosed, for example, in U.S. Pat. No. 4,875,585 issued to Kadleck et al.

A second form of horizontal dividing member is formed from a plurality of panels cut from at least one sidewall, and each of the one or more partition walls and extends continuously across the interior of the carrier. This type of horizontal dividing member is known, for example, in U.S. Pat. No. 4,640,417 issued to Durand.

Because of the competitive nature of the glassware industry, packaging technology has developed rapidly. The emphasis has been on carriers which can be made from a single piece blank, can be flattened for storage and can easily be erected to receive and present the glassware or other articles to be displayed. Thus, although prior art carriers having horizontal dividing members are generally satisfactory for certain applications, there continues to be a need for improved collapsible carriers having a horizontal dividing member which can be readily filled with articles with a minimum of manipulation, which offers ease of use and which attractively displays articles in the carrier.

SUMMARY OF THE INVENTION

The present invention provides a display carrier having a horizontal dividing member which is easy to use, offers improved article security and presents the articles attractively. In one embodiment, the present invention provides a carrier sleeve having top and bottom walls, first and second sidewalls, a vertical partition wall and a horizontal dividing member in the sleeve. The vertical partition wall extends between the top and bottom walls to define adjacent interior compartments within the sleeve. The horizontal dividing member is disposed parallel to the bottom wall, spaced vertically above the bottom wall, and passes through the vertical partition wall to extend between the first and second sidewalls. The horizontal dividing member separates each compartment into two spaces, each for receiving an article of glassware. The horizontal dividing member contains contoured recesses which may match the cross-sectional outline of the bottom portion of articles to be held within the carrier sleeve.

In one embodiment, the horizontal dividing member is connected to the first and second sidewalls of the sleeve and comprises a plurality of separate horizontal panels including: (1) a first horizontal panel that is cut primarily from the bottom wall and is connected to the first sidewall along a horizontal fold line where the panel intersects the first sidewall and which extends from the first sidewall to the partition wall; and (2) a second horizontal panel that also is cut primarily from the bottom wall and is connected to the partition wall along a horizontal fold line where the panel intersects the partition wall and which extends from the partition wall to the second sidewall where it is secured by means of a terminal glue flap. The two horizontal panels are glued together and thus form a substantially horizontal dividing member which is connected to both sidewalls of the sleeve.

In another embodiment, the horizontal dividing member comprises a horizontal panel extending continuously as a single piece. Opposite ends of the dividing member stop just short of the respective sidewalls. The horizontal panel is cut primarily from the vertical partition wall as a single piece and is connected to the partition wall along a pair of aligned horizontal hinge lines where the panel intersects the partition wall. Support members cut primarily from the bottom wall are used for supporting the opposed ends of the horizontal panel to form a substantially horizontal dividing member.

Generally, the display carrier is formed from a unitary, planar cardboard blank which is die cut and creased to form all the various walls and the panels of the carrier. The blank is folded and glued to form a carrier sleeve which may be stored flat and subsequently erected to form a display carrier for displaying articles disposed in a pair of rows.

As employed herein, when a panel is defined as being "cut primarily" from a particular wall or portion of the display carrier, it denotes that greater than 50% of the panel and, more often, greater than 60% or more of the panel has been cut from the particular wall or carrier portion referred to. Also, when dividing members according to the invention are denoted as being "substantially horizontal" it is intended to include dividing members wherein most of the components are in a horizontal configuration (i.e., parallel with the top and bottom walls), but which also may include a minor number of components such as glue flaps, support members, and the like, that are in a non-horizontal configuration.

DESCRIPTION OF PREFERRED EMBODIMENTS

Figure 1:
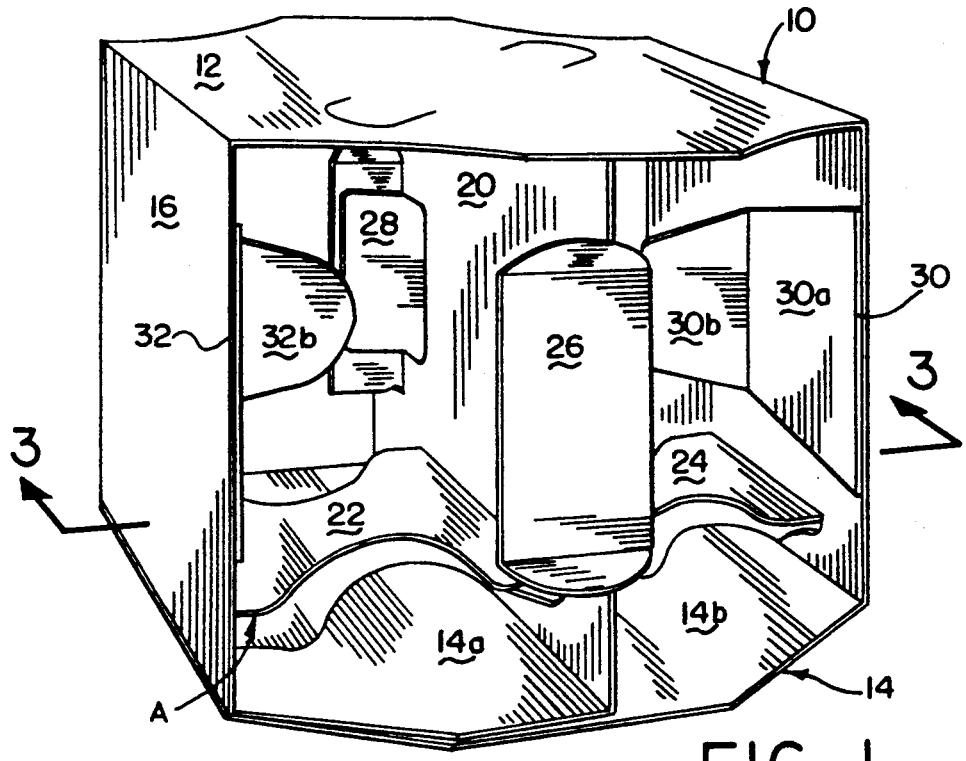
FIG. 1 is a perspective illustration of a carrier constructed in accordance with one embodiment of the present invention.
Figure 2:
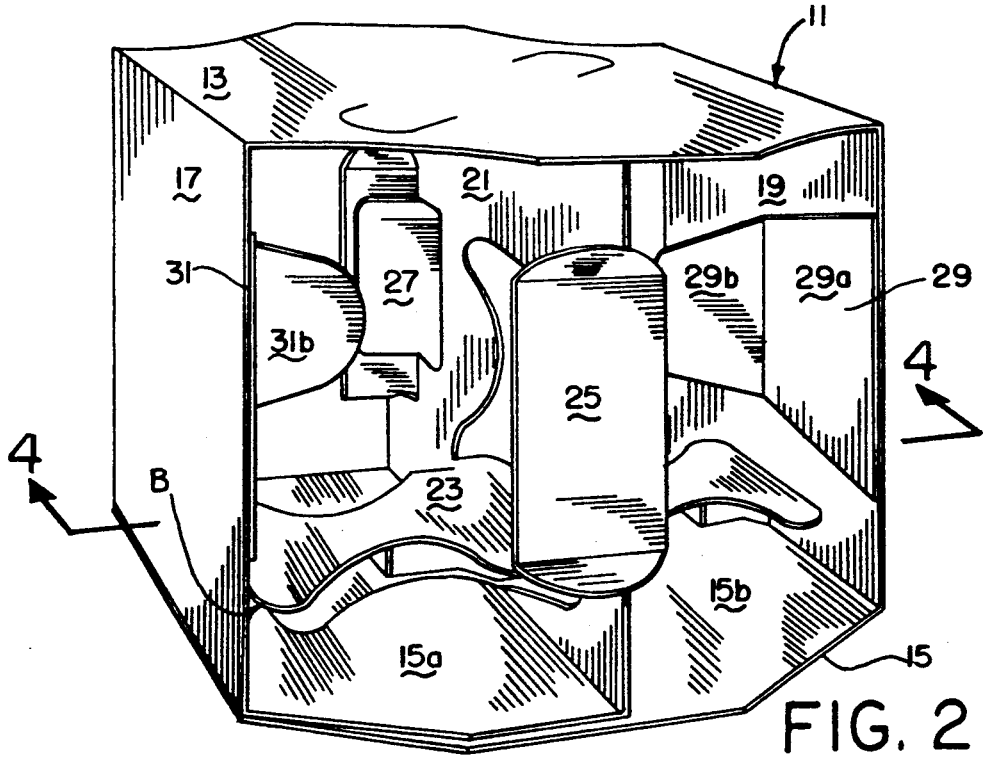
FIG. 2 is a perspective illustration of a carrier constructed in accordance with another embodiment of the present invention.

Referring now to the drawings which show illustrative, but nonlimiting embodiments of article display carriers according to the invention, in FIGS. 1 and 2 there are shown paperboard display carrier sleeves 10 and respectively, for holding articles such as glasses. The illustrated display carriers are particularly adapted to accommodate conventional glassware, and the invention will be described with reference thereto. However, it is intended that the invention may comprise display carrier embodiments adapted securely to retain other articles as well.

The display carriers 10 and 11 are substantially identical except for the respective horizontal dividing members A and B as will be described herein. More specifically, display carrier 10 (FIG. 1) comprises top wall 12, bottom wall 14, sidewalls 16 and 18, partition wall 20, and a substantially horizontal dividing member A formed from horizontal panels 22 and 24. Similarly, display carrier 11 (FIG. 2) comprises top wall 13, bottom wall 15, sidewalls 17 and 19, partition wall 21 and a horizontal dividing member B formed from a horizontal panel 23.

In both display carriers 10 and 11 the various top and bottom walls and sidewalls form a closed sleeve with opposed open ends for insertion and removal of glassware. The vertical partition walls 20 and 21 in each carrier extend vertically between top and bottom walls to define adjacent interior compartments for holding glasses between the respective sidewalls. The bottom walls 14 and 15 each comprise a pair of panels (14*a*–14*b*) and 15*a*–15*b*), respectively, which are secured to each other to form the bottom wall.

In both display carriers 10 and 11 the sidewalls 16–19 are narrower between the open ends of the carrier than the combined diameters of glasses (not shown) to be held in the associated interior compartments for the purpose of display. In addition, the top and bottom walls 12–15 of display carriers 10 and 11 have an octagonal shape to reduce the amount of carton material which otherwise would cover the sides and edges of the glasses to be displayed, and thereby both reduce material cost and increase product exposure for retail display and sale.

Means for securely retaining glasses within the open ends of display carriers 10 and 11 are provided as shown in FIGS. 1–2. The retaining tabs 25–28 are each pivotally connected to a respective partition wall 20, 21. Broadly, retaining tabs 25–28 are displaceable from a first position generally parallel to a respective partition wall for article insertion to a second position generally perpendicular to the partition wall for article retention. A detailed description of these retaining tabs may be found in copending, commonly assigned U.S. patent application Ser. No. 07/622,566 filed Dec. 5, 1990 which is incorporated by reference herein. The retaining tabs 25–28 may be replaced or supplemented by other conventional retaining means known in the art.

Means for separating the upper portion or middle of articles to be inserted in display carriers 10 and 11 to reduce clinking also are provided as shown in FIGS. 1–2. Specifically, separating tabs 29–32 are each pivotally attached along a vertical fold line to one open end of the display carrier 10–11 at an end edge of a respective sidewall 16–19. The separating tabs 29–32 are each comprised of a first panel designated by the reference numeral of a respective tab 29–32 followed by (a) and a second panel designated by the reference numeral followed by (b).

In use, the separating tabs 29–32 each initially form a generally planar extension of a respective sidewall 16–19 at one open end of the carrier 10–11. A pair of glasses are then inserted into a carrier (10, 11) through one open end opposed to the end to which the separating tabs 29–32 are attached. A second pair of glasses are inserted and bear against the separating tabs 29–32 which pivot inwardly until the first panel a rests generally parallel with a sidewall and the second panel b mechanically engages an adjacent glass which causes it to pivot to a position perpendicular to a respective sidewall 16–19 (see FIGS. 1—2). In this way, panels b of separating tabs 29–32 are positioned between top portions of adjacent pairs of articles which reduces contact during shipping and handling. The vertical position of the tabs 29–32 along the edges of the carrier as well as their shape depend on the contour of the glassware to be displayed in the carrier. Further they may be replaced by tabs folded down from the top 12 or 13, again depending on where the adjacent glasses are most likely to touch each other.

Figure 3:
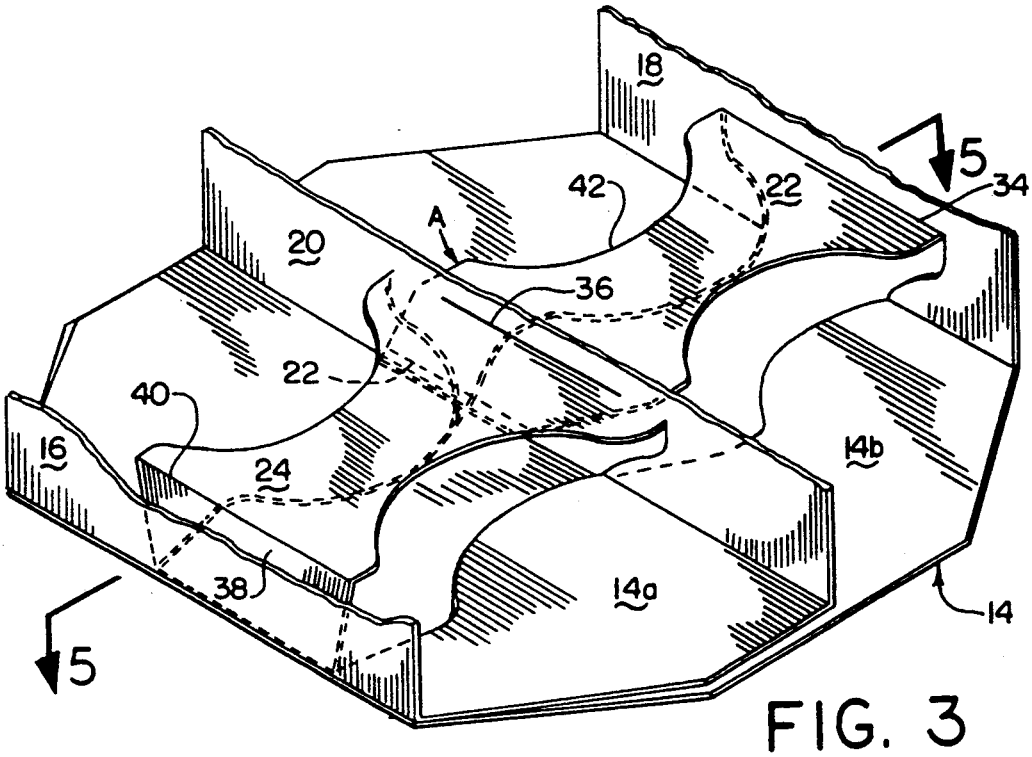
FIG. 3 is a cutaway view taken along 3—3 of the carrier shown in FIG. 1.
Figure 5:
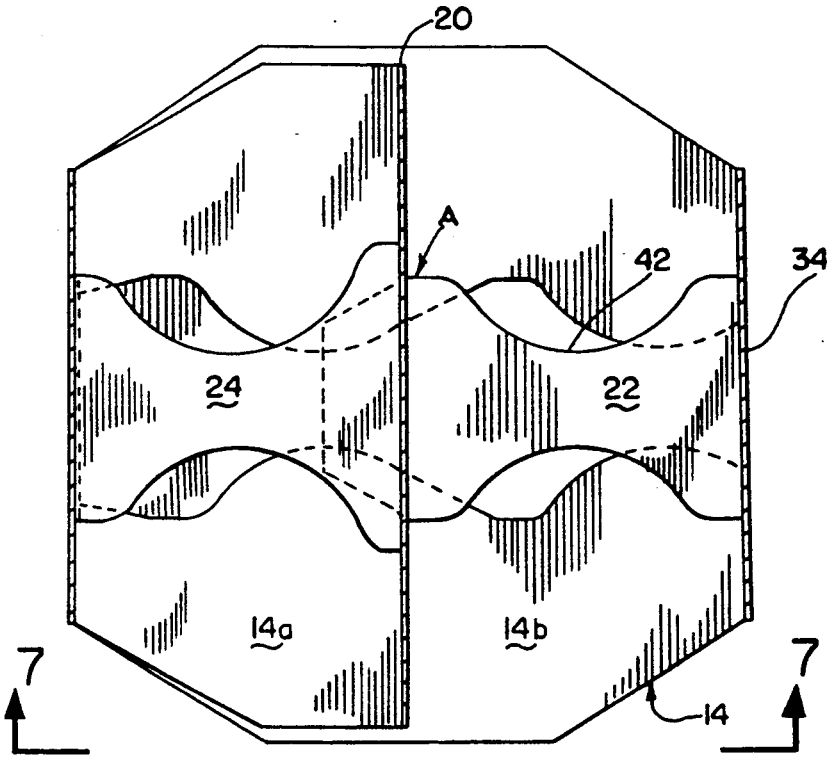
FIG. 5 is a plan view looking generally in the direction of arrows 5—5 of FIG. 3.
Figure 7:
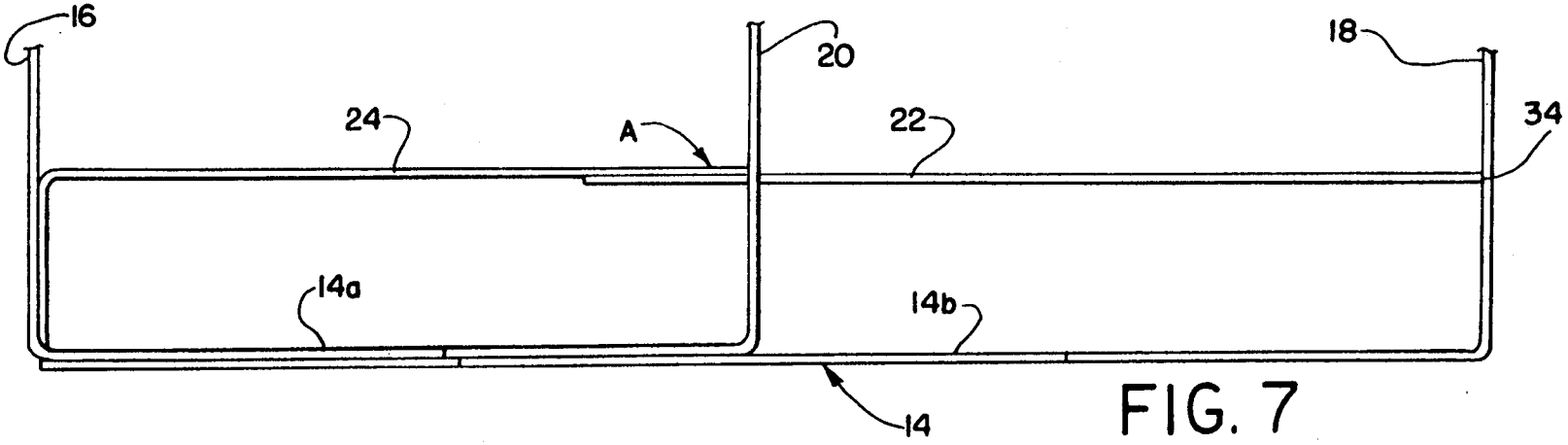
FIG. 7 is a partial elevation view looking in the direction of arrows 7—7 shown in FIG. 5.
Figure 9:
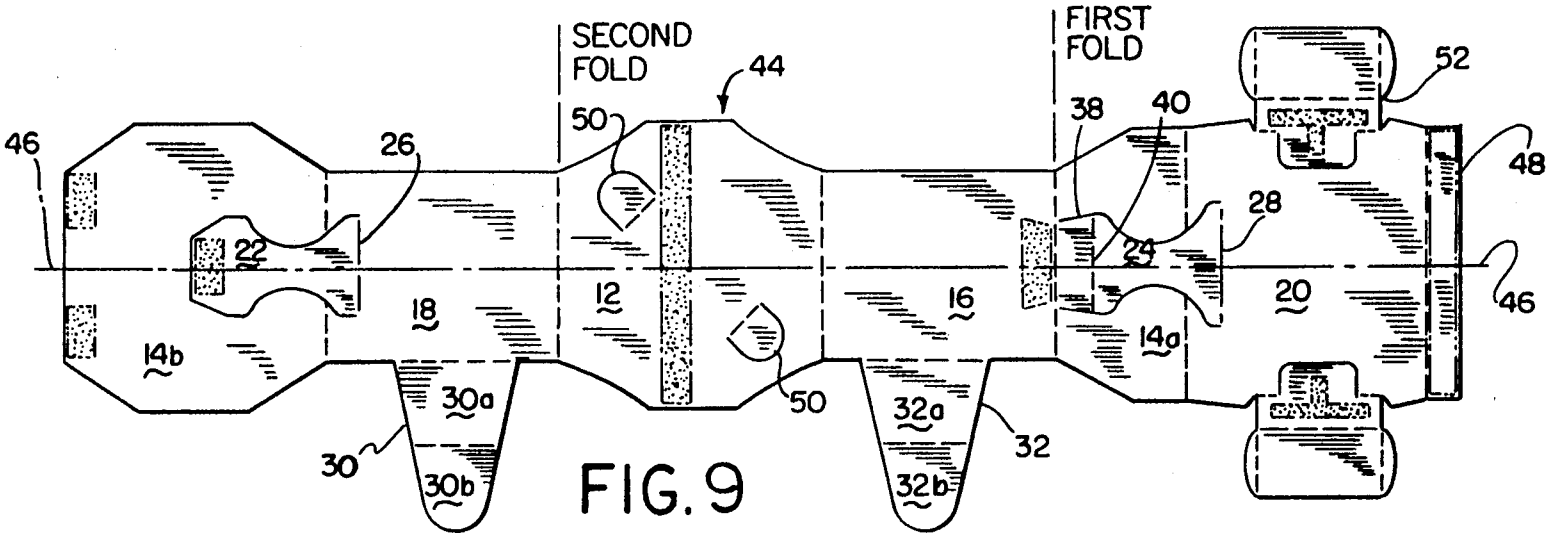
FIG. 9 is a plan view of a blank from which the carrier of FIG. 1 may be formed.

FIGS. 3, 5 and 7 show the horizontal dividing member A of the carrier 10 of FIG. 1. The substantially horizontal dividing member A is generally parallel to bottom wall 14, spaced vertically therefrom and is formed from panels 22 and 24. As shown in FIGS. 3 and 9, the first panel 22 is cut primarily from bottom wall panel 14*b* with a minor portion cut from sidewall 18.

The first panel 22 is taken out of the plane of the bottom wall panel 14*b* by being rotated about horizontal fold line 34 toward partition wall 20. As shown in FIGS. 5 and 7, first panel 22 extends through the plane of partition wall 20 and overlaps second panel 24 to which it is glued. As seen in FIG. 3, second panel 24 is cut primarily from bottom wall panel 14*a* with a minor portion being cut from partition wall 20. The second panel 24 is taken out of the plane of the bottom wall by being rotated about horizontal fold line 28 toward sidewall 16 and is glued to sidewall 16 by glue flap 32 which is pivotally attached to second panel 24 along fold line 40.

Each of the panels 22 and 24 which constitute the horizontal portion of the dividing member A have contoured recesses 42 which match the cross-sectional outline of a portion of the glassware or other articles to be held within the carrier. As noted above, the carrier can be adapted for articles other than glassware by selecting an appropriate contoured recess for the dividing member.

As shown in the Figures, the dividing member A is contoured to engage the glassware relatively close to its bottom. In an actual carton about 4 ¼ inches tall, the dividing member A is about ¾ inch up from the bottom wall 14. If it is desirable to engage the glassware higher up, the fold lines 28 and 26 are moved up their respective walls. This has the additional result of changing how much of each of the panels 22 and 24 is cut from the side wall 18 and partition wall 20, respectively. Moving the dividing member A upward increases the amount of each of these panels that is formed from these walls and decreases the amount of each cut from the bottom panels 14*a* and 14*b*, respectively.

It will be readily appreciated by those skilled in the art that the horizontal dividing member A will comprise more than two panels in carriers having more than one vertical partition wall. In such carriers, the first panel 22 will remain the same as shown in FIG. 3, but will not overlap the second panel 24. In such multiple partition wall carriers, intermediate panels similar to first panel 22 (i.e., with no folded glue flap) will extend from the additional partition walls. Also, in such multiple partition wall carriers the terminal partition wall (i.e., the one adjacent to the first sidewall 16) would contain a panel similar to second panel 24.

Figure 4:
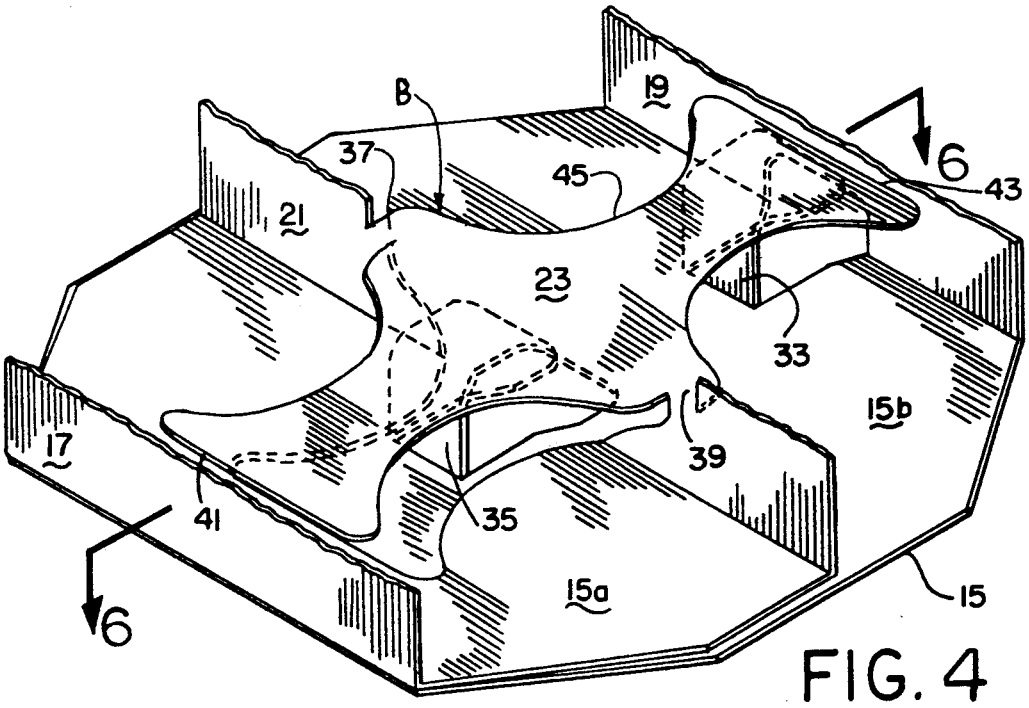
FIG. 4 is a cutaway view taken along 4—4 of the carrier shown in FIG. 2.
Figure 6:
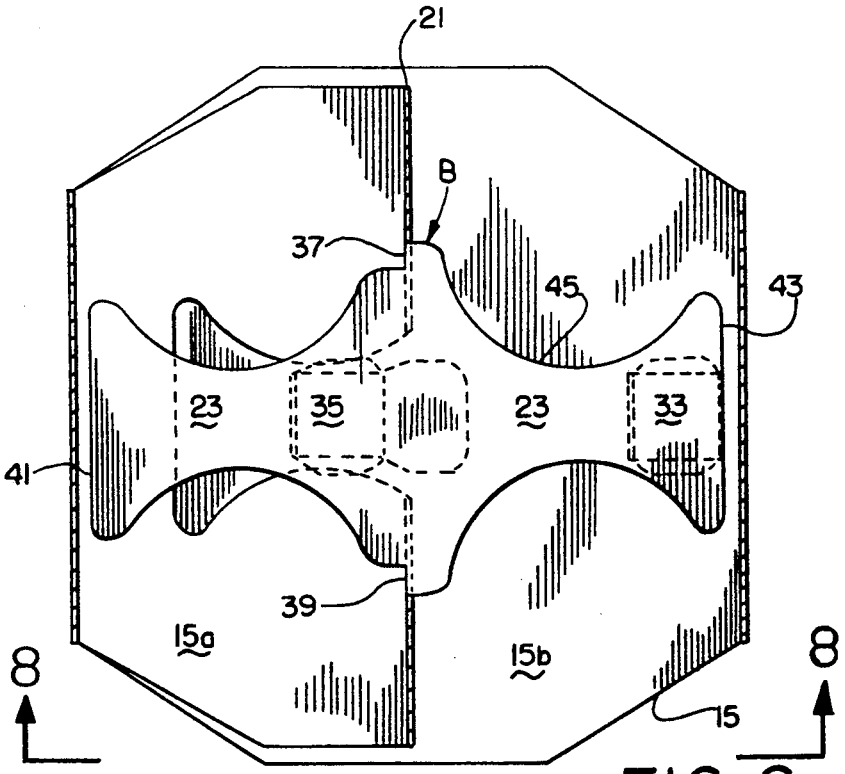
FIG. 6 is a plan view looking generally in the direction of arrows 6—6 of FIG. 4.
Figure 8:
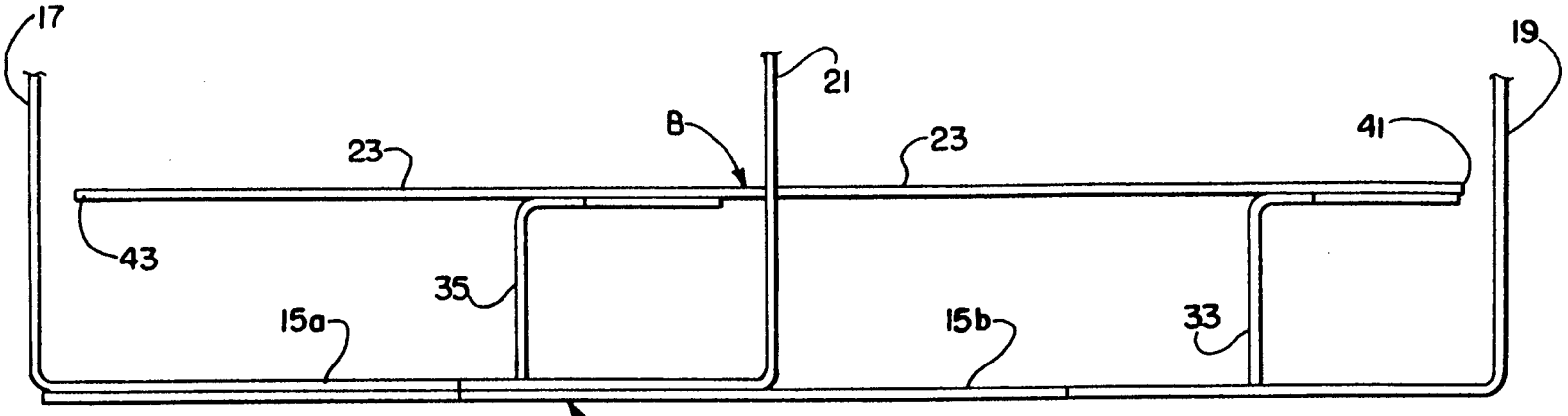
FIG. 8 is a partial elevation view looking in the direction of arrows 8—8 in FIG. 6.

Turning now to FIG. 4, which is a cutaway view of the display carrier 11 shown in FIG. 2, another embodiment of a horizontal dividing member is shown. The horizontal dividing member B is substantially parallel to bottom wall 15, is spaced vertically therefrom and comprises a horizontal panel 23 and support members 33 and 35. As seen in FIGS. 2 and 4, horizontal panel 23 is cut primarily from partition wall 21 with a minor portion being cut from bottom wall panel 15*a*. The horizontal panel 23 is taken out of the plane of partition wall 21 by being rotated about aligned horizontal hinge lines 37 and 39 where the panel 23 intersects and is integral with partition wall 21. As shown in FIGS. 6 and 8, horizontal panel 23 extends continuously as a single piece of paperboard material across the interior of display carrier 11 between but not touching sidewalls 17 and 19. The opposed end edges 41 and 43 of panel 23 are horizontally spaced from and proximate to respective sidewalls 17 and 19. The horizontal panel 23 also has contoured recesses 45 which match the cross-sectional outline of a portion of the articles to be held within the carrier. As noted above, the carrier can be adapted to hold articles other than glassware by altering the shape of the contoured recess.

The horizontal dividing member B also includes support members 33 and 35. Support member 33 is cut from bottom wall panel 15*b*, and support member 35 is cut primarily from bottom wall panel 15*b*, with a minor portion being cut from sidewall 19. Both support members 33 and 35 swing out of the plane of bottom wall 15 and extend vertically therefrom to make a glue attachment to horizontal panel 23. As with the support member A, moving the support member vertically in the partition wall will change the source of the supporting legs 33 and 35.

Figure 10:
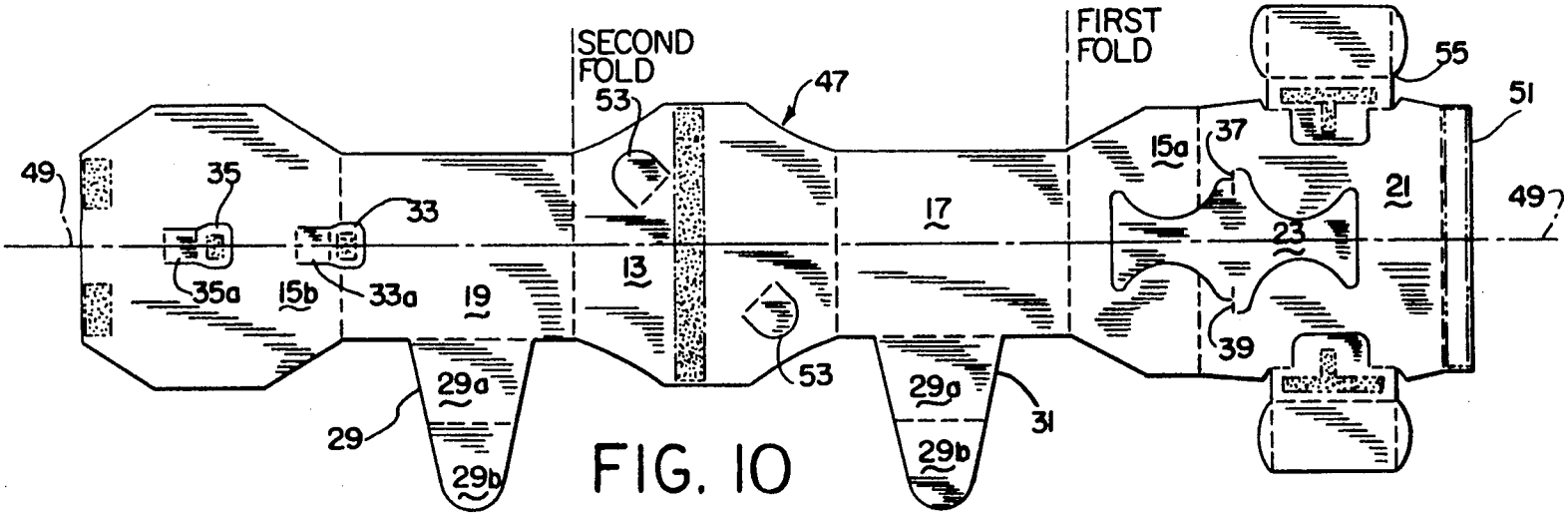
FIG. 10 is a plan view of a blank from which the carrier of FIG. 2 may be formed.

FIGS. 9 and 10 show paperboard blanks 44 and 47 adapted to be constructed on a conventional folding machine to form display carriers 10 and 11. Each blank is an elongated sheet of paperboard having laterally extended transverse folding lines (shown as dotted lines) which are perpendicular to longitudinal axes 46 and 49 and define successive panels along the length of each sheet. Shaded regions show where glue is placed. The top walls 12 and 13 of the respective blanks contain arcuate cut out tabs 50 and 53 which swing inwardly to serve as finger holes to facilitate lifting when the carrier is erected and contains glassware.

Proceeding in longitudinal succession from left to right in FIG. 9, the blank 44 includes a bottom wall panel 14*b*, sidewall 18, top wall 12, sidewall 16, bottom wall panel 14*a*, partition wall 20 and glue flap 48. Each panel is pivotable with respect to its adjacent panel about the transverse folding line between them.

The article dividing member A of display carrier 10 described above is formed within blank 44 from the two panels 22 and 24. The first panel 22 is formed within blank 44 as a component of bottom wall panel 14*b* and sidewall 18. Sidewall 18 includes a first internal fold line 26 extending partially thereacross which defines one edge of panel 22. The balance of the perimeter of panel 22 which is defined by a first cut line extending toward bottom wall panel 14*b* and between the ends of internal folding line 26. The result is that the first panel 22 is cut primarily from the bottom wall panel 14*b*. First panel 22 is pivotable out of the plane of blank 44 allowing it to be secured to second panel 24 when the display carrier is constructed.

Similarly, second panel 24 is formed within blank 44 as a component of bottom wall panel 14*a* and partition wall 20. Partition wall 20 includes a second internal folding line 28 extending partially thereacross. Second panel 24 is defined by a pair of second cut lines extending from one side of line 28 toward bottom wall panel 14*a* and fold line 40 such that the second panel is blanked or cut primarily from the bottom wall panel 14*a*. Fold line 40 hingedly connects glue flap 38 to the second panel 24. In one embodiment glue flap 38 is attached directly to sidewall 16 along the transverse fold line between bottom wall panel 14*a* and sidewall 16. Like first panel 22, second panel 24 pivots out of the plane of blank 44 when display carrier 10 is constructed in order to form the horizontal dividing member A discussed above.

Proceeding in longitudinal succession from left to right in FIG. 10, blank 47 includes top wall panel 15*b*, sidewall 19, top wall 13, sidewall 17, bottom wall panel 15*a*, partition wall 21 and glue flap 51. As in blank 44, each panel in blank 47 is pivotal with respect to an adjacent panel about the laterally extended transverse folding line (shown as dotted lines) extending therebetween. Horizontal panel 23 is formed within blank 47 as a component of partition wall 21 and bottom wall panel 15*a*.

Panel 23 is defined by first and second cut lines extending on opposed sides of the aligned fold lines 37 and 39. The first cut line extends on one side of the fold lines 37 and 39 toward bottom wall panel 15*a* to join the proximal ends of aligned fold lines 37 and 39. The second cut line extends on the other side of the fold lines 37 and 39 toward the partition wall 21 to join the distal ends of aligned fold lines 37 and 39. Thus panel 23 is cut primarily from the partition wall 21 (second cut line) with a minor portion being cut from the bottom wall panel 15*a* (first cut line). Panel 23 pivots about aligned fold lines 37 and 39 to swing out of the plane of blank 47 when the display carrier is constructed.

The panel 23 is supported horizontal when the carrier is erect by support members 33 and 35. Support member 33 is formed as a component of bottom wall panel 15*b* and sidewall 19 whereas support member 35 is formed completely as a component of bottom wall panel 15*b*. Each includes a leg portion 33*a* and 35*a* and a distal glue flap 33*b* and 35*b* which holds the respective support member to the panel 23. The support members 33 and 35 pivot out of the plane of bottom wall panel 15*b* to engage horizontal panel 23 in order to form a substantially horizontal article dividing member B when the carrier is erect.

Blanks 44 and 47 are folded to form carriers 10–11 as follows. As is conventional, glue is applied to the shaded regions of one planar side of the blanks as illustrated in FIGS. 9–10. If retainers such as 52 and 55 are provided, they are folded along their longitudinal fold lines. Then in a first folding operation, the partition walls 20–21 and bottom wall panels 14*a* and 15*a*, respectively, are pivoted 180° along the transverse fold lines which divide panels 14*a*–15*a* from their respective sidewalls 16–17 until glue flaps 48 and 51 contact a respective adhesive region in top walls 12–13. Next in a second folding operation, bottom wall panels 14*b*–15*b* and sidewalls 18–19, respectively, are pivoted 180° along the transverse fold lines which divide sidewalls 18–19 from their respective top walls 12–13. The blanks 44 and 47, when folded and glued as noted above, are sufficiently constructed into flattened carriers 10–11 to the extent necessary for shipment or storage.

To erect the display carriers 10–11 thus formed to the configurations shown in FIGS. 1–2, each flattened structure is oriented such that top walls 12–13 are facing upward. A worker then presses the lateral fold lines which separate top walls 12–13 from sidewalls 18–19 toward the lateral fold lines which separate bottom wall panels 14*a*–15*a* from sidewalls 16–17. This results in a carrier disposed in an upright, article receiving position.

In addition to defining separate spaces in the adjacent compartments defined by the vertical partition wall, the horizontal dividing members A and B discussed above increase the strength and rigidity of the display carrier by, in one embodiment, joining the partition wall with the sidewalls and, in another embodiment, joining the partition wall with the bottom wall. Because the horizontal dividing member is formed as an integral component of one or more walls of the display carrier, the need for an additional amount of material to secure glassware and stiffen the carrier is avoided and the amount of material to accomplish these functions is minimized.

The invention has been described with reference to the preferred embodiments. Obviously, however, modifications and alterations will occur to others upon the reading and understanding of this specification. It is therefore intended to include all such modifications insofar as they come within the scope of the appended claims or equivalence thereof.

What is claimed is:

1. A collapsible carrier for articles, said carrier being formed from a sheet of foldable material and being movable between a collapsed condition for shipping and storage and an erect condition for receiving and holding articles, said carrier comprising:

horizontal top and bottom walls and first and second vertical sidewalls hingedly connected to form a carrier sleeve having opposed open ends;

a vertical partition wall in said sleeve hingedly connected to said top and bottom walls to define adjacent interior compartments within said sleeve;

each of said walls having opposed end edges at the open ends of said carrier sleeve;

a substantially horizontal dividing member in said sleeve extending between said sidewalls and through said partition wall, said dividing member being disposed parallel to said bottom wall and spaced vertically therefrom, and securing means for holding said dividing member free of contact with the side walls of the carrier and substantially parallel to said bottom wall when said carrier is in the erect condition.

2. A collapsible carrier according to claim 1 wherein said securing means includes support members for supporting said horizontal panel generally parallel to said bottom wall, each support member extending vertically from said bottom wall to a position proximate a respective opposed end of said horizontal panel.

3. A collapsible carrier for articles, said carrier being formed from a sheet of foldable material and being movable between a collapsed condition for shipping and storage and an erect condition for receiving and holding articles, said carrier comprising:

horizontal top and bottom walls and first and second vertical sidewalls hingedly connected to form a carrier sleeve having opposed open ends;

a vertical partition wall in said sleeve hingedly connected to said top and bottom walls to define adjacent interior compartments within said sleeve;

each of said walls having opposed end edges at the open ends of said carrier sleeve;

a substantially horizontal dividing member in said sleeve extending between said sidewalls and through said partition wall, said dividing member being disposed parallel to said bottom wall and spaced vertically therefrom, and securing means for holding said dividing member substantially parallel to said bottom wall when said carrier is in the erect condition;

said securing means including support members for supporting said horizontal panel generally parallel to said bottom wall, each support member extending vertically from said bottom wall to a position proximate a respective opposed end of said horizontal panel; each of said support members including a leg portion movable from an initial position coplanar with said bottom wall when the carrier is in the collapsed condition to a final position transverse to the plane of said bottom wall when the carrier is in the erect position and a glue flap for attaching the leg portion to said dividing member.

4. A collapsible carrier according to claim 3 wherein said horizontal panel is connected to said partition wall along two aligned fold lines by which said panel intersects and is integral with said partition wall.

5. A collapsible carried according to claim 3 wherein said horizontal dividing member along its longitudinal edges has contoured recesses conforming with the cross-sectional outline of a portion of said articles.

6. The carrier of claim 5 wherein longitudinally opposite end portions of said dividing member are free of contact with the side walls of the carrier.

7. A collapsible carrier for articles, said carrier being formed from a sheet of foldable material and being movable between a collapsed condition for shipping and storage and an erect condition for receiving and holding articles, said carrier comprising:

horizontal top and bottom walls and first and second vertical sidewalls hingedly connected to form a carrier sleeve having opposed open ends;

a vertical partition wall in said sleeve hingedly connected to said top and bottom walls to define adjacent interior compartments within said sleeve;

each of said walls having opposed end edges at the open ends of said carrier sleeve;

a substantially horizontal dividing member in said sleeve extending between said sidewalls and through said partition wall, said dividing member being disposed parallel to said bottom wall and spaced vertically therefrom, securing means for holding said dividing member substantially parallel to said bottom wall when said carrier is in the erect condition; and a separating tab connected to each sidewall at an end edge thereof, each separating tab having first and second panels, each separating tab being displaceable from a first position in which the separating tab is generally planar with the sidewall to which it is attached and a second position in which said first panel is generally parallel to said sidewall and said second panel is generally perpendicular to said sidewall.

8. A collapsible carrier for articles, said carrier being formed from a sheet of foldable material and being movable between a collapsed condition for shipping and storage and an erect condition for receiving and holding articles, said carrier comprising:

horizontal top and bottom walls and first and second vertical sidewalls hingedly connected to form a carrier sleeve having opposed open ends;

a vertical partition wall in said sleeve hingedly connected to said top and bottom walls to define adjacent interior compartments within said sleeve;

each of said walls having opposed end edges at the open ends of said carrier sleeve;

a substantially horizontal dividing member in said sleeve extending between said sidewalls and through said partition wall, said dividing member being disposed parallel to said bottom wall and spaced vertically therefrom, and securing means for holding said dividing member substantially parallel to said bottom wall when said carrier is in the erect condition, said securing means including a glue flap for connecting one end portion of said dividing member to a sidewall of the carrier;

said dividing member in said sleeve including a plurality of horizontal panels, said dividing member extending between said sidewalls and through at least one partition wall, said dividing member being disposed parallel to said bottom wall and spaced vertically therefrom, said dividing member comprising:

a first panel cut at least partially from said bottom wall and connected to said first sidewall;

a second panel cut at least partially from said bottom wall and connected to said partition wall; and means for securing said first and second panels to each other.

9. A collapsible carrier according to claim 8 wherein said horizontal dividing member has contoured recesses conforming with the cross-sectional outline of a portion of said articles.

10. A collapsible carrier according to claim 8 wherein said first panel extends through the plane of said partition wall and overlaps said second panel.

11. A collapsible carrier according to claim 10 wherein said first panel is adhesively secured to said second panel.

12. A collapsible carrier according to claim 8 which further comprises a separating tab connected to each sidewall at an end edge thereof, each separating tab having first and second panels, each separating tab being displaceable from a first position in which the separating tab is generally planar with the sidewall to which it is attached and a second position in which said first panel is generally parallel to said sidewall and said second panel is generally perpendicular to said sidewall.

13. A foldable blank for forming a collapsible carrier for articles comprising a longitudinally extending cardboard sheet having a periphery and plurality of parallel fold lines transverse to the longitudinal axis of said blank that define a plurality of distinct planar sections along the length of said sheet, each planar section having opposed end edges, said sections comprising, in longitudinal succession, a first bottom wall panel, a first sidewall, a top wall, a second sidewall, a second bottom wall panel, a partition wall and a glue flap; a pair of aligned internal fold lines in said partition wall, said fold lines being perpendicular to the longitudinal axis of said blank, said fold lines having proximal and distal ends; and a dividing panel defined by a first continuous internal cut line which extends on one side of said aligned internal fold lines toward said second bottom wall panel and which is entirely within the periphery of the blank and a second continuous internal cut line which extends on the other side of said aligned internal fold lines toward said partition wall and which is entirely within the periphery of the blank, said dividing panel being cut primarily from said partition wall and rotatable out of the plane of said partition wall into a rotated position wherein said dividing panel extends from said aligned internal fold lines on opposite sides of said partition wall.

14. A foldable blank for forming a collapsible carrier for articles comprising a longitudinally extending cardboard sheet having a plurality of parallel fold lines transverse to the longitudinal axis of said blank that define a plurality of distinct planar sections along the length of said sheet, each planar section having opposed end edges, said sections comprising, in longitudinal succession, a first bottom wall panel, a first sidewall, a top wall, a second sidewall, a second bottom wall panel, a partition wall and a glue flap; a first internal fold line in said first sidewall and a second internal fold line in said partition wall, said first and second internal fold lines being perpendicular to the longitudinal axis of said blank; and first and second dividing panels, said first dividing panel being defined by a first cut line which extends on one side of said first fold line toward said first bottom wall panel, said second dividing panel being defined by a second cut line which extends on one side of said second fold line towards said second bottom wall panel, said first and second dividing panels being cut primarily from said first and second bottom wall panels, respectively, and being rotatable out of the plane of said respective first and second bottom wall panels into a rotated position wherein said first and second dividing panels extend from said first and second fold lines on one side of said respective first and second bottom wall panels.

15. A foldable blank for forming a collapsible carrier for articles comprising a longitudinally extending cardboard sheet having a plurality of parallel fold lines transverse to the longitudinal axis of said blank that define a plurality of distinct planar sections along the length of said sheet, each planar section having opposed end edges, said sections comprising, in longitudinal succession, a first bottom wall panel, a first sidewall, a top wall, a second sidewall, a second bottom wall panel, a partition wall and a glue flap; a pair of aligned internal fold lines in said partition wall, said fold lines being perpendicular to the longitudinal axis of said blank, said fold lines having proximal and distal ends; and a dividing panel defined by a first continuous internal cut line which extends on one side of said aligned internal fold lines toward said second bottom wall panel and a second continuous internal cut line which extends on the other side of said aligned internal fold lines toward said partition wall, said dividing panel being cut primarily from said partition wall, including a minor portion cut from said second bottom panel, and being rotatable out of the plane of said partition wall into a rotated position wherein said dividing panel extends from said aligned internal fold lines on opposite sides of said partition wall.

* * * * *